US007830296B2

(12) United States Patent
Moore

(10) Patent No.: US 7,830,296 B2
(45) Date of Patent: Nov. 9, 2010

(54) ANECHOIC STRUCTURES FOR ABSORBING ELECTROMAGNETIC INTERFERENCE IN A COMMUNICATIONS MODULE

(75) Inventor: Joshua John Edward Moore, Collingwood (CA)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 12/144,935

(22) Filed: Jun. 24, 2008

(65) Prior Publication Data

US 2009/0015456 A1 Jan. 15, 2009

Related U.S. Application Data

(60) Provisional application No. 60/949,159, filed on Jul. 11, 2007.

(51) Int. Cl.
*H01Q 17/00* (2006.01)
*H04K 3/00* (2006.01)
*H04K 1/00* (2006.01)

(52) U.S. Cl. ..... 342/4; 342/1; 342/13; 342/175; 398/39

(58) Field of Classification Search ..... 342/1–20, 342/175; 333/22 R, 22 F, 81 R, 81 A, 81 B; 174/32, 350, 377–397; 343/700 R, 703; 324/600, 612, 627, 628; 398/39, 118–172, 398/182–214; 720/600, 648, 650
See application file for complete search history.

(56) References Cited

U.S. PATENT DOCUMENTS 3,806,943 A * 4/1974 Holloway ..... 343/703
4,218,683 A * 8/1980 Hemming ..... 343/703
4,507,660 A * 3/1985 Hemming ..... 342/1
4,901,080 A * 2/1990 McHenry ..... 342/1
4,906,998 A * 3/1990 Shibuya ..... 342/4
4,931,798 A * 6/1990 Kogo ..... 342/4
4,972,191 A * 11/1990 Ishino et al. ..... 342/1
5,053,712 A * 10/1991 Hansen ..... 324/627
5,134,405 A * 7/1992 Ishihara et al. ..... 342/1
5,311,191 A * 5/1994 Scannapieco ..... 342/1
5,331,453 A * 7/1994 Lipsky ..... 398/204
5,510,792 A * 4/1996 Ono et al. ..... 342/4
5,688,348 A * 11/1997 Diaz et al. ..... 342/4
6,008,753 A * 12/1999 Berg et al. ..... 342/4
6,437,748 B1 * 8/2002 Burnside et al. ..... 343/703
7,102,562 B2 * 9/2006 Moller et al. ..... 342/4
7,190,301 B2 * 3/2007 Krenz et al. ..... 342/1
7,466,142 B2 * 12/2008 Garreau et al. ..... 342/1
7,479,917 B2 * 1/2009 Kurihara et al. ..... 342/1

* cited by examiner

*Primary Examiner*—Bernarr E Gregory
(74) *Attorney, Agent, or Firm*—Workman Nydegger

(57) ABSTRACT

A communications module includes an interior configuration designed to intercept, disrupt, and scatter EMI produced by the module during operation. The interior configuration may include an anechoic structure that includes a plurality of anechoic elements positioned proximate EMI-producing components within the module. The anechoic elements may form truncated pyramids, columns having rounded tops, cones, or other shapes. The anechoic elements may be uniform or non-uniform in size, length, or shape and can be arranged in a periodic, non-periodic, or random pattern. In some embodiments, the anechoic elements may include cast zinc metal, Nickel, and/or radiation absorbent material, such as a mixture of iron and carbon. In operation, EMI impinging on the anechoic elements is scattered by their surfaces until absorbed by the elements or other structures of the module, thereby preventing the EMI from exiting the module.

20 Claims, 6 Drawing Sheets

ANECHOIC STRUCTURES FOR ABSORBING ELECTROMAGNETIC INTERFERENCE IN A COMMUNICATIONS MODULE

CROSS-REFERENCE TO RELATED APPLICATIONS

This application claims the benefit of U.S. Provisional Patent Application Ser. No. 60/949,159 filed Jul. 11, 2007 and entitled ANECHOIC STRUCTURES FOR SCATTERING ELECTROMAGNETIC INTERFERENCE IN A COMMUNICATIONS MODULE, the contents of which are herein incorporated by reference in their entirety.

BACKGROUND OF THE INVENTION

1. The Field of the Invention

The present invention generally relates to communications modules. In particular, the present invention relates to a communications module, such as an optical transceiver module, having specialized internal structures configured to reduce EMI emission from the module during operation.

2. The Relevant Technology

Computing and networking technology has transformed our world. As the amount of information communicated over networks steadily increases, high speed transmission becomes ever more critical. Many high speed data transmission networks rely on optical transceivers and similar devices for facilitating transmission and reception of digital data embodiment in the form of optical signals over optical fibers. Optical networks are thus found in a wide variety of high speed applications ranging from modest Local Area Networks ("LANs") to backbones that define a large portion of the infrastructure of the Internet.

Typically, data transmission in such networks is implemented by way of an optical transmitter (also referred to as an "electro-optic transducer"), such as a laser or Light Emitting Diode ("LED"). The electro-optic transducer emits light when current is passed through it, the intensity of the emitted light being a function of the magnitude of the current. Data reception is generally implemented by way of an optical receiver (also referred to as an "opto-electric transducer"), an example of which is a photodiode. The opto-electric transducer receives light and generates a current, the magnitude of the generated current being a function of the intensity of the received light.

Various other components are also employed by the optical transceiver to aid in the control of the optical transmit and receive components, as well as the processing of various data and other signals. For example, the optical transmitter is typically housed in a transmitter optical subassembly ("TOSA"), while the optical receiver is housed in a separate receiver optical subassembly ("ROSA"). The transceiver also typically includes a driver (e.g., referred to as a "laser driver" when used to drive a laser signal) configured to control the operation of the optical transmitter in response to various control inputs and an amplifier (e.g., often referred to as a "post-amplifier") configured to amplify the channel-attenuated received signal prior to further processing. A controller circuit (hereinafter referred to as the "controller") controls the operation of the laser driver and post-amplifier.

As optical transmission speed provided by transceivers and other communications modules rises, so does the production of potentially problematic electromagnetic interference ("EMI"). EMI produced by the module can interfere with the proper operation of the transceiver or other adjacent electronic components, and is therefore undesired. The FCC regulates the amount of EMI that a device can emit in terms of a Db power limit. There is a significant competitive advantage to reducing the emitted EMI from a consumer product. In particular, reducing EMI emitted at the component level increases the number of components that can be populated into a system without violating FCC regulations.

A need therefore exists for the reduction of EMI emitted from communications modules, including transceivers and transponders. Moreover, any solution to this need would desirably provide a solution that does not substantially alter the form factor of the transceiver or other communications module.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

These and other limitations are overcome by embodiments of the invention which relate to systems and methods for intercepting, disrupting, and scattering EMI produced by communications modules, such as optical transceiver and transponder modules, during operation. Advantageously, embodiments of the invention reduce the amount of EMI emitted by communications modules without substantially altering the form factor of the communications modules.

According to embodiments of the invention, a communications module, such as an optical transceiver module, is provided that comprises a shell including a top shell portion, a printed circuit board positioned within the shell, and an anechoic structure positioned on an inner surface of the top shell portion to disrupt and disperse EMI. Alternately or additionally, the anechoic structure can be positioned on other inner surfaces of the communications module. The printed circuit board includes at least one component that produces or generates EMI.

The anechoic structure may include a plurality of anechoic elements configured to intercept, scatter, absorb, and otherwise disrupt the EMI. The anechoic structure may be positioned proximate to the EMI-emitting component(s) when the top shell portion is in a closed position such that the anechoic elements extend towards the EMI-emitting component(s).

The anechoic elements can be arranged in a periodic, non-periodic, or random pattern and may be uniform or non-uniform in size, length, or shape. For instance, in some embodiments the anechoic elements are all the same length, while in other embodiments some of the anechoic elements are a first length while other of the anechoic elements are a second length. Alternately or additionally, in some embodiments all of the anechoic elements are the same shape while in other embodiments the anechoic elements are different shapes. The anechoic element shapes may include truncated pyramids, columns with rounded tops, and cones. Further, the anechoic elements may include cast zinc metal, Nickel, and/or radiation absorbent materials such as a mixture of iron and carbon.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to figures wherein like structures will be identified with like reference designations. It is understood that the drawings are diagrammatic and schematic representations of exemplary embodiments of the invention, and are not limiting of the present invention, nor are they necessarily drawn to scale.

FIGS. 1-6E depict various features of embodiments of the present invention, which is generally directed to a communications module, such as an optical transceiver module, that includes an interior configuration designed to intercept, disrupt, and scatter electromagnetic interference ("EMI") produced by the module during operation. Interception of EMI in this manner results in improved operation of the module and integrity of the data signals carried thereby.

Figure 1:
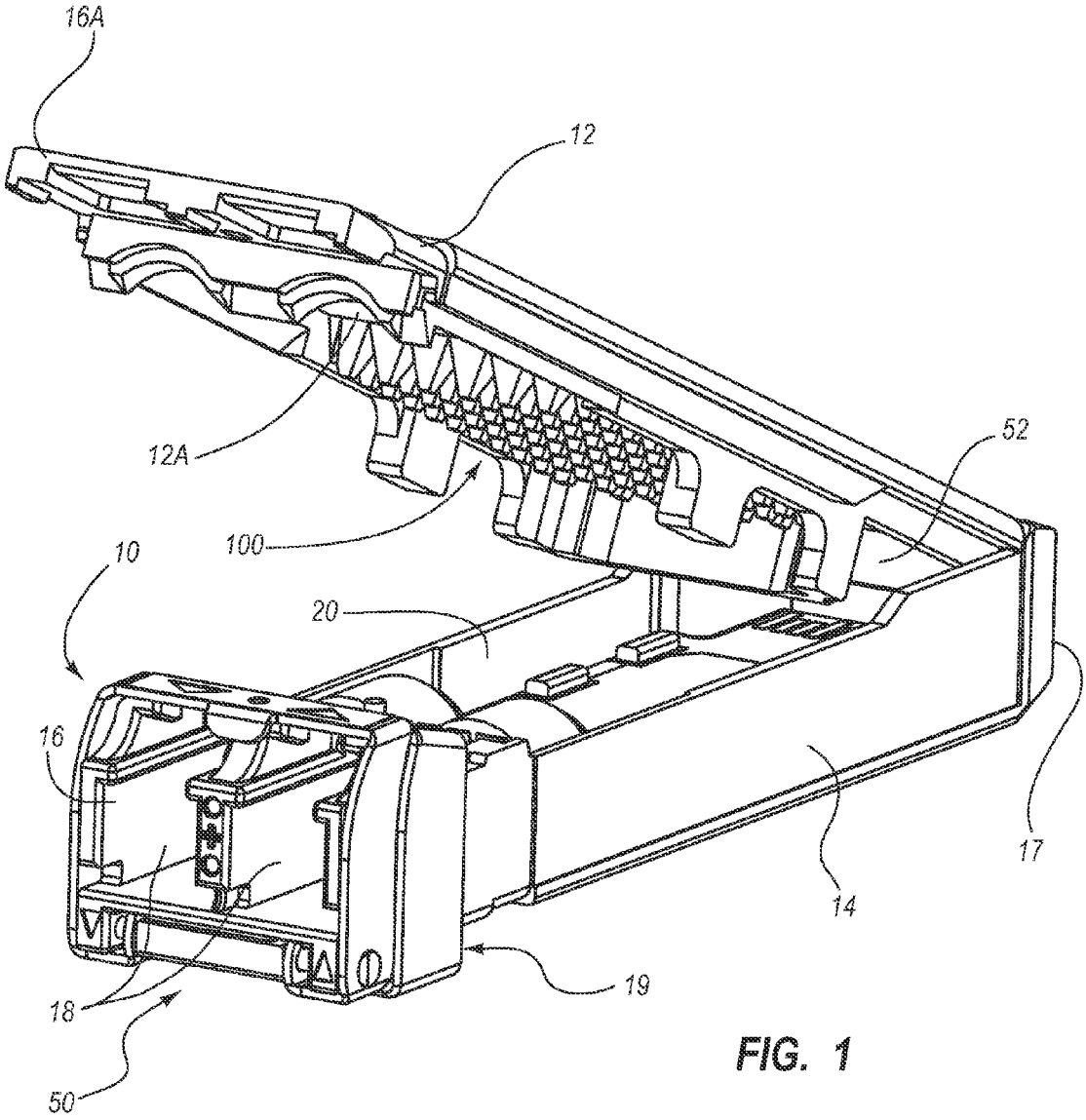
FIG. 1 is a perspective view of an optical transceiver module including an internal EMI disruption structure, according to one example embodiment.
Figure 2:
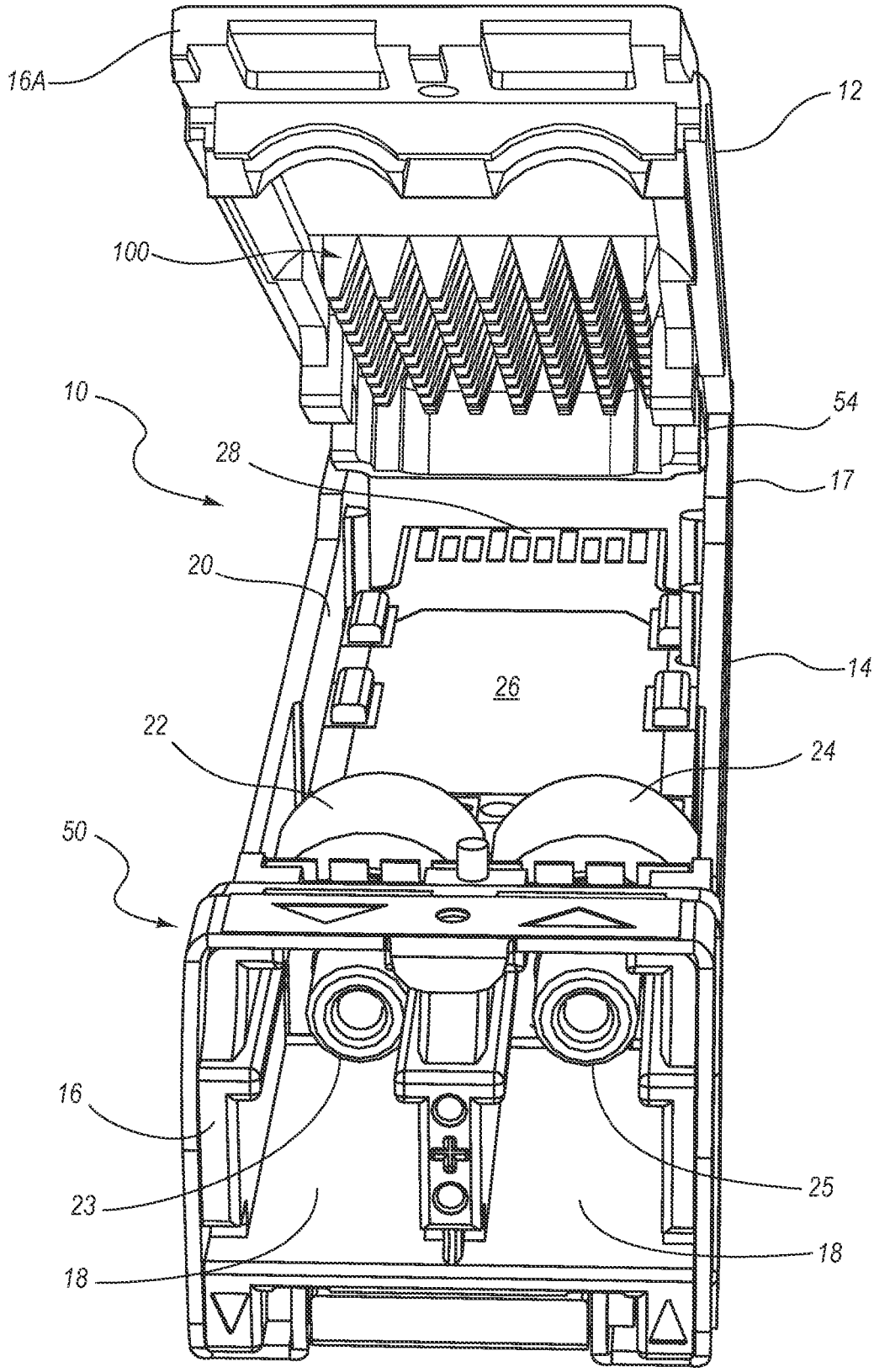
FIG. 2 is a perspective end view of the transceiver of FIG. 1, showing various features of the EMI disruption structure.

Reference is first made to FIGS. 1 and 2, which show a communications module, specifically, an optical transceiver module ("transceiver"), generally designated at 10. Though illustrated in an SFP configuration, the transceiver 10 is merely representative of various communications modules and transceivers that can benefit from the principles of embodiments of the present invention as described herein.

As shown in FIG. 1, the transceiver 10 includes a body composed of a top shell portion 12 and bottom shell portion 14. The bottom shell portion 14 defines a front end 16 and a back end 17 of the transceiver 10, while the top shell portion 12 defines a corresponding front end 16A and back end 17A. The top shell portion 12 also defines an inner surface 12A that bounds the interior of the transceiver when assembled.

Included on the front end 16 of the transceiver bottom shell portion 14 are two ports 18 configured to receive connectors of an optical fiber (not shown). The ports 18 define a portion of an interface portion 19 that is generally included on the front end 16 of the transceiver 10 and that includes the structures necessary to operably connect the transceiver 10 to optical fibers. Also disposed on the transceiver front end 16 is a bail latch assembly 50 that enables the transceiver to be selectively removed from a port, such as the port of a host device (not shown).

As best seen in FIG. 2, the bottom shell portion 14 defines a cavity 20 in which a transmitter optical subassembly ("TOSA") 22, a receiver optical subassembly ("ROSA") 24, and printed circuit board ("PCB") 26 are included as internal components of the transceiver 10. The TOSA 22 and ROSA 24 each include a nosepiece 23 and 25, respectively, that extends into a respective one of the ports 18 so as to be positioned to mate with the connector portion of an optical fiber (not shown) when received within each port.

A terminal end of the PCB 26 nearest the back end 17 of the transceiver 10 includes an edge connector 28 that is configured to operably connect with a corresponding connector (not shown) of the host device. In addition, a hinge 52 is defined on the back end 17A of the top shell portion 12 and is configured to cooperatively engage with a hinge seat 54 defined near the back end 17 of the bottom shell portion so as to enable the two shell portions to mate, thereby enclosing the cavity 20. Of course, the transceiver or other communications module may include other types of mating configurations.

FIGS. 1 and 2 further depict various views of an anechoic structure, generally designated at 100 , which is designed to disrupt and disperse EMI produced within the transceiver 10 during operation, with the aim of preventing the EMI from interfering with the proper transmission of signals to, from, or within the transceiver. Further details regarding the anechoic structure are given further below.

Note that, while described in some detail herein, the optical transceiver 10 is discussed by way of illustration only, and not by way of restricting the scope of the invention. For example, the optical transceiver 10 in one embodiment can be suitable for optical signal transmission and reception at a variety of per-second data rates, including, but not limited to, 1 Gigabit per second ("G"), 2 G, 4 G, 8 G, 10 G, or higher bandwidth fiber optic links. Also, the principles of the present invention can be implemented in optical transceivers of any form factor such as XFP, SFP, SFP+, IPF, and SFF, without restriction. Furthermore, communications modules of other types and configurations, such as optical transponders, or having components that differ in some respects from those shown and described herein, can also benefit from the principles disclosed herein.

During operation, the transceiver 10 can receive a data-carrying electrical signal from a host, which can be any computing system capable of communicating with the optical transceiver 10, for transmission as a data-carrying optical signal on to an optical fiber (not shown). The electrical differential data signal is provided to a light source, such as a laser located in the TOSA 22, which converts the electrical signal into a data-carrying optical signal for emission on to an optical fiber and transmission via an optical communications network, for instance. The laser (not shown) can be an edge-emitting laser diode, a vertical cavity surface emitting laser ("VCSEL"), a distributed feedback ("DFB") laser, or other suitable light source. Accordingly, the TOSA 22 serves as an electro-optic transducer.

In addition, the transceiver 10 is configured to receive a data-carrying optical signal from an optical fiber (not shown) via the ROSA 24. The ROSA 24 acts as an opto-electric transducer by transforming the received optical signal, via a photodetector or other suitable device included in the ROSA, into an electrical signal. The resulting electrical signal is then provided to the host device in which the transceiver 10 is received.

Figure 3:
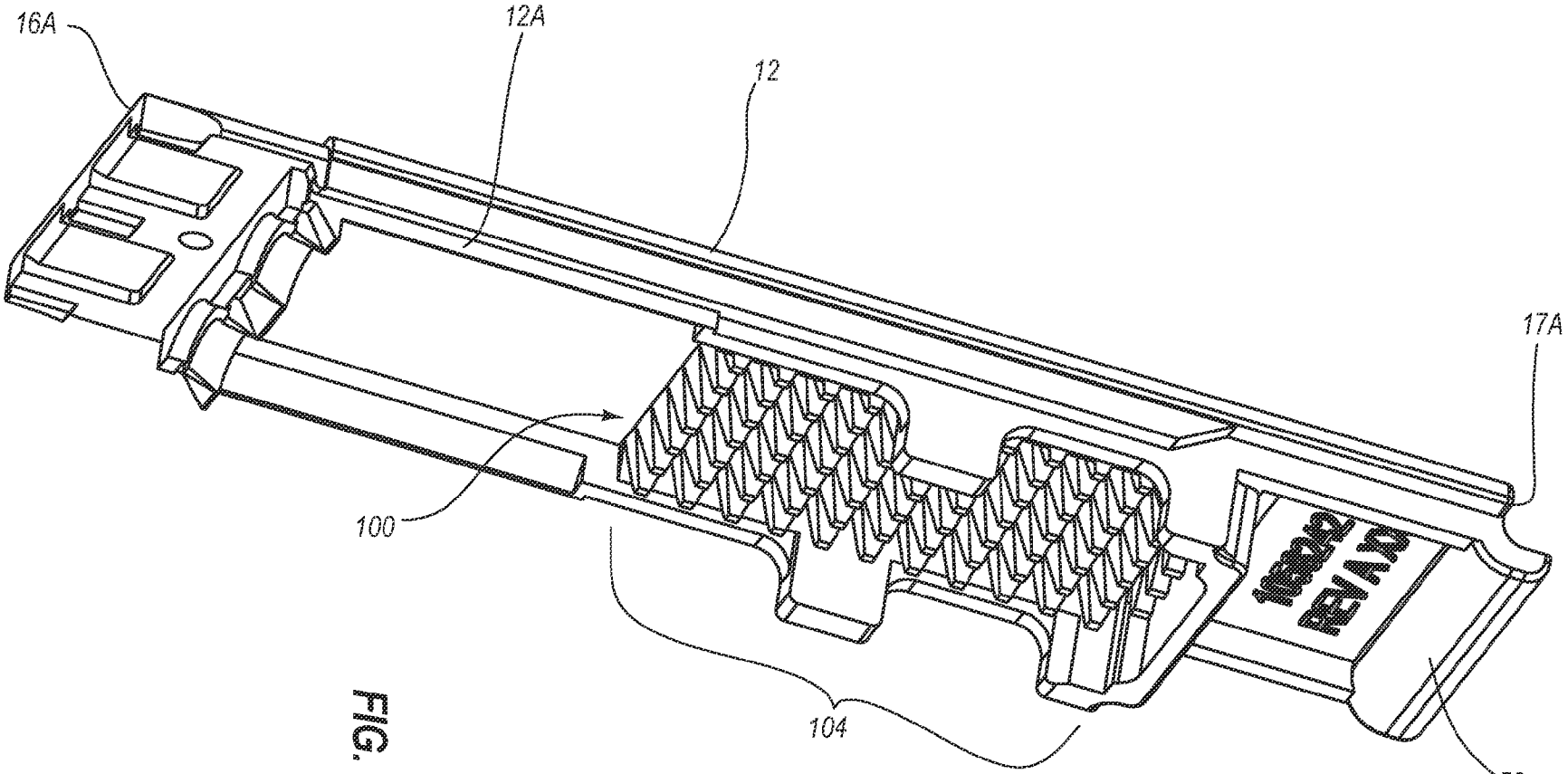
FIG. 3 is a perspective view of a top shell portion of the transceiver of FIG. 1, including the EMI disruption structure.
Figure 4:
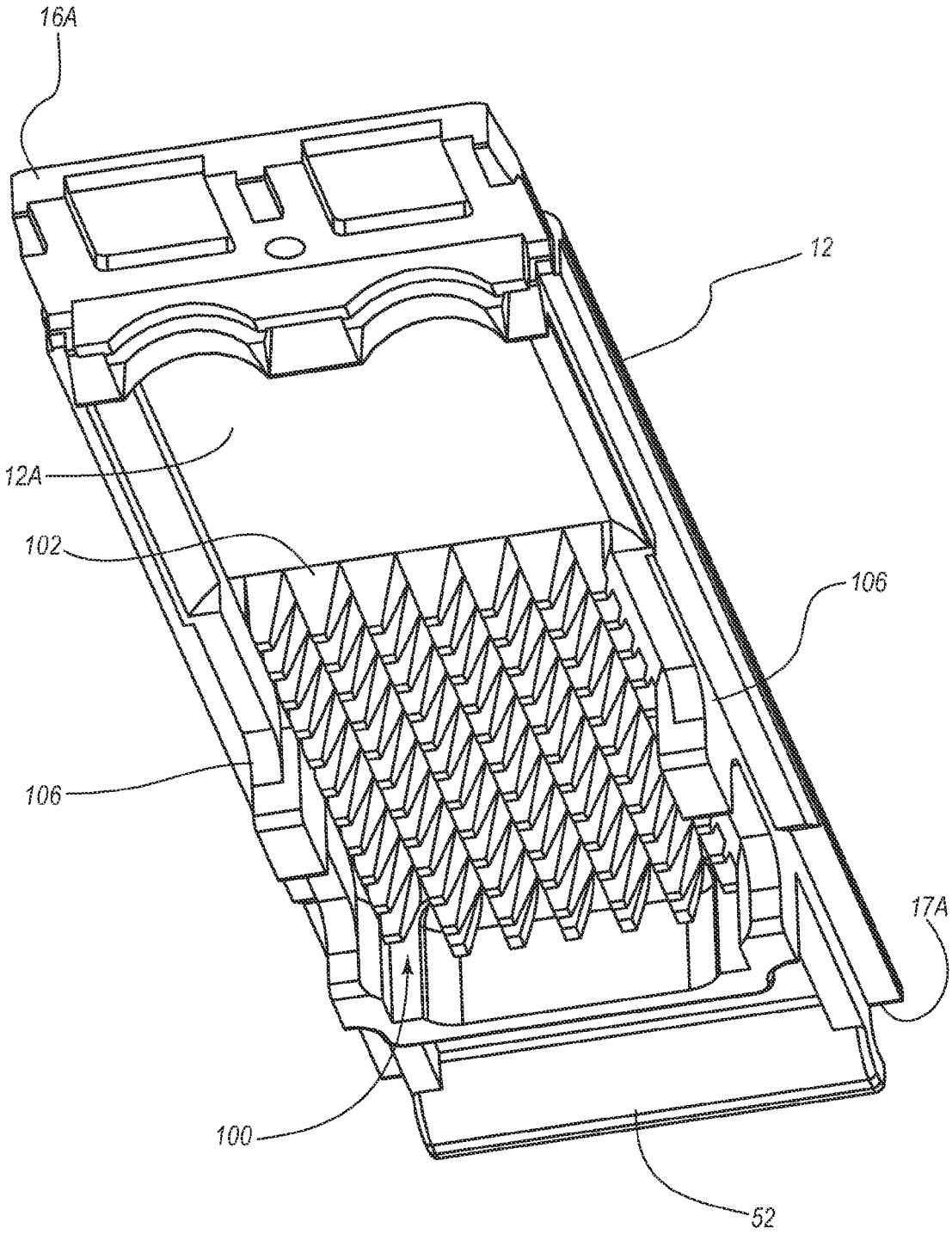
FIG. 4 is a perspective view of the underside of the top shell portion of FIG. 3, showing another view of the EMI disruption feature.

Together with FIGS. 1 and 2, reference is now made to FIGS. 3 and 4 in describing further details regarding the anechoic structure 100. As mentioned, the anechoic structure 100 is included in the transceiver 10 to intercept and disperse EMI emissions produced by the transceiver and prevent them from interfering with signals of the transceiver or of other nearby modules.

In greater detail, the anechoic structure 100 includes a plurality of anechoic elements ("elements") 102 that are shaped so as to effectively intercept and disperse EMI incident thereon. In the illustrated embodiment, the elements 102 are arranged in a regular periodic pattern on a portion of the inner surface 12A of the transceiver top shell portion 12. As best seen in FIG. 3, the elements 102 are arranged in block format on a predetermined portion 104 of the top shell portion inner surface 12A The position of the anechoic structure 100 on the top shell portion inner surface 12A coincides with the position of the PCB 26 (FIG. 2) and the components thereon that produce EMI within the transceiver 10. So configured, the elements 102 are positioned proximate to such components so as to be able to intercept and scatter component-emitted EMI before it can escape the transceiver shell. Further, as in the present embodiment, the anechoic elements 102 can be placed in rows and columns in a plane that is parallel with the PCB 26 such that the anechoic elements extend in a direction normal to the plane (i.e., the plane in which the PCB 26 is disposed) in which the components are positioned.

Note that the position of the elements 102 can be different from what is shown in the present figures. For instance, the elements 102 can be positioned forward of what is shown in FIG. 3 (e.g., more towards the front 16A of the top shell portion 12), or the elements can be split into two or more coverage regions on the inner surface of the top shell. Thus, the placement of the elements shown in the present figures is merely exemplary and is not intended to limit the present invention in any way.

As best seen in FIG. 4, the elements 102 are arranged in rows and columns within the placement region 104. In the illustrated embodiment, the elements 102 are positioned side-by-side in a 7×11 grid with a $12^{th}$ row of 5 elements (near the back end 17A of the top shell portion 12 as best seen in FIG. 4), though this grid can be modified in size according to the needs of a particular application. In another embodiment, the elements can be positioned in a non-periodic or random manner, if needed or desired.

In one embodiment the anechoic elements 102 are most effective in absorbing EMI if they are constructed or coated with a radiation absorbent material ("RAM"). These materials typically contain mixtures of iron and carbon, and are neither highly electrically conductive nor insulative. However, a conductive material can be used to provide a disruptive surface to scatter and dissipate concentrated EMI frequencies. In the present example, the surfaces of the anechoic elements 102 are made from cast zinc metal, and plated with Nickel. These anechoic surfaces could easily be formed entirely from a RAM and used as drop in components to suppress EMI. Likewise the zinc cast anechoic structures could be coated with a RAM to produce suitable EMI suppression.

Figure 5:
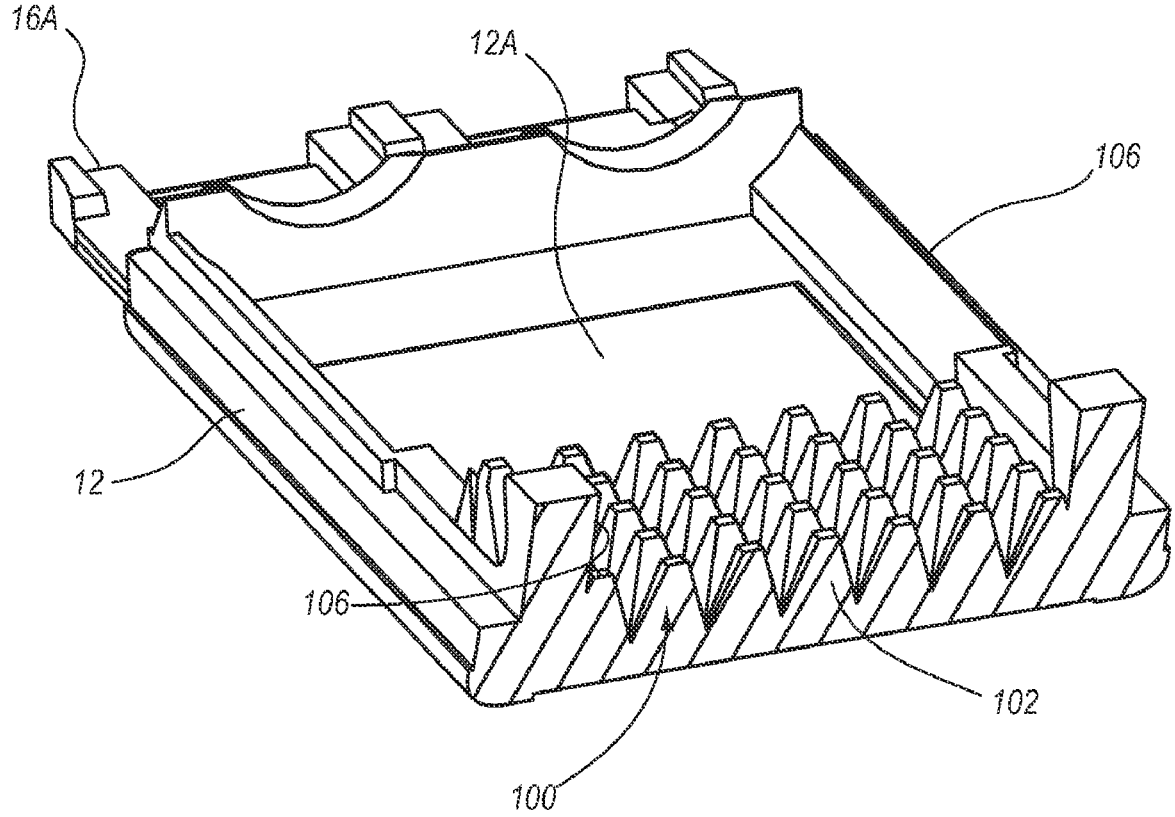
FIG. 5 is a perspective cross sectional view of the EMI disruption structure included on the top shell portion of the transceiver of FIG. 1, showing the shape of the various anechoic elements thereof.

FIG. 5 shows that the shape of each element 102 of the anechoic structure 100 defines a truncated pyramid and that each element is similarly sized and shaped. The length of each element 102 is defined to coincide with the problematic wavelength being generated within the module. Generally EMI will peak at the harmonic transmission signals, 1 G, 2 G, 4 G, 8 G, 10 G, etc., and their respective quarter wavelengths. As such, it is appreciated that element length can vary depending on the application. Generally, relatively long element lengths can better absorb, disrupt, and dissipate lower frequency EMI than relatively short element lengths.

In general, an effective measure of determining the element length is to use a length of at least $\lambda/20$ where $\lambda$ is the wavelength of the EMI frequency. In the present example, for instance, the element length is 1.75 mm, which corresponds to a wavelength of 35 mm and an EMI frequency of 8.5 Ghz. This length, of course, can vary according to EMI disruption needs, component type, etc. The number, spacing, and size of the elements can also be modified. For instance, though the placement region 104 includes 82 anechoic elements as shown in FIGS. 3 and 4, the same area could be equally covered by fewer and relatively larger—or more and relatively smaller—anechoic elements, in one embodiment.

Likewise, the anechoic elements 102 of FIGS. 1-5 are shown only on the inner surface 12A of the top shell portion 12 so as to be positioned above the PCB 26, according to the orientation of the transceiver 10 as shown in FIG. 1. In another example embodiment, however, the anechoic elements could be included above, below, on the back, front, and/or sides on the inside of the transceiver (e.g., on an inner surface of the shell in some embodiments) so as to partially or completely surround the PCB or other EMI emitting component(s). For example, in one embodiment the anechoic elements could be included on all surfaces surrounding the EMI generating components so as to substantially disrupt all EMI emanating from the components.

FIG. 5 shows that the anechoic structure 100 is positioned between side walls 106 of the top shell portion 12, thereby not interfering with closure of the transceiver 10.

During operation, with the transceiver 10 having its top and bottom shell portions 12 and 14 in a mated configuration, the elements 102 of the anechoic structure 100 are positioned proximate any EMI-producing components on the PCB 26. As such, when EMI is produced by the PCB components or other transceiver components, the anechoic elements 102 are positioned to intercept the EMI soon after its production.

Upon impinging the elements 102, the EMI is scattered by the various pyramidal surfaces of each element until the EMI is absorbed by one or more of the elements or other structure of the transceiver 10. As such, the EMI is prevented from either travel extensively within the transceiver 10 or exiting the transceiver. In this way, the EMI is prevented from interfering with data signals being produced or traveling within the transceiver or in nearby transceivers. In other words, the anechoic elements 102 disrupt the path of EMI and absorb EMI energy. The elements 102 therefore produce a disruptive surface inside the transceiver 10 that prevents the transceiver from acting as a channel waveguide. Smooth surfaces inside the module can direct full energy EMI towards the front of the module and out of the ports 18. By disrupting and absorbing the EMI generated inside the transceiver 10, the level of EMI escaping from the transceiver can be reduced.

Figure 6A:
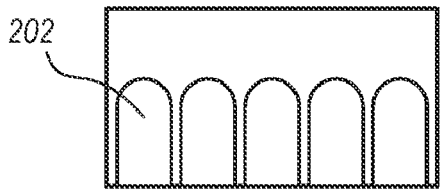
FIGS. 6A-6E are simplified cross sectional views of various possible anechoic element shapes, according to example embodiments of the present invention.
Figure 6B:
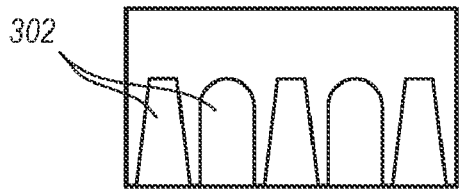
Figure 6C:
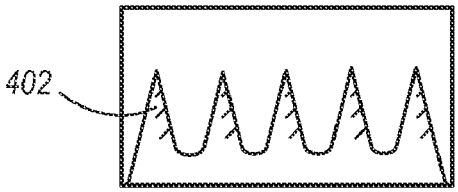

Reference is now made to FIGS. 6A-6D. As mentioned, the particular shape and configuration of the anechoic elements can be modified from what is shown in the previous embodiments while still preserving the intended functionality. FIGS. 6A-6D depict various examples of other anechoic element designs that can be incorporated into the anechoic structure 100. FIG. 6A, for instance, shows a plurality of representative anechoic elements 202, wherein each element is a column having a rounded top portion. In FIG. 6B, a mixed anechoic element combination is shown, including truncated pyramid elements interposed between rounded-top column elements, both designated at 302. This embodiment depicts the option of using differently configured anechoic elements within a single anechoic structure. As such, anechoic elements having a variety of shapes and configurations can be used in such an implementation as is exemplarily shown here. FIG. 6C depicts another possible anechoic structure design, wherein anechoic elements 402 are each conically shaped.

Figure 6D:
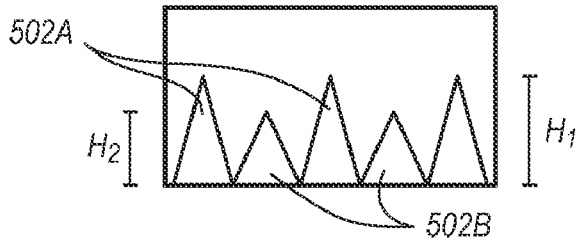

As already mentioned, the anechoic elements need not be uniform in shape/size. FIG. 6D gives an example of such an embodiment, wherein relatively tall elements 502A having a height H1 are interposed between relatively shorter elements 502B having a height H2. Note that, though placed side-by-side one another, the elements can be spaced apart from each other, if desired or needed for a particular application.

Figure 6E:
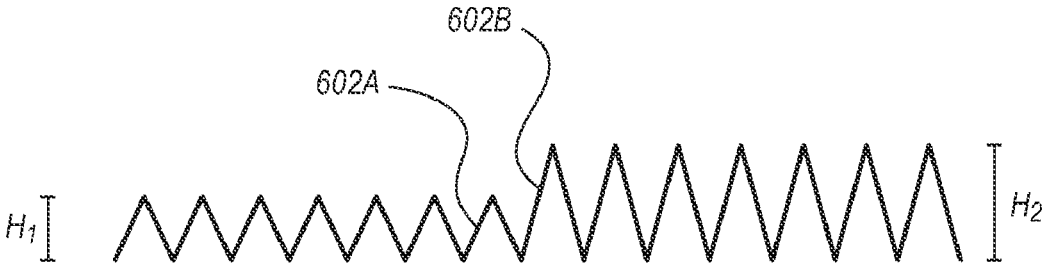

FIG. 6E depicts yet another embodiment, wherein the anechoic structure includes a first section of elements 602A having a height H1, and a second section of elements 602B having a relatively greater height H2. Unlike the embodiment shown in FIG. 6D, the differently sized elements are segregated into sections according to their respective heights. This design may be desired where relatively more EMI is emitted from components disposed on a first section of the PCB surface—corresponding to the relatively taller elements 602B—than from components disposed on a second section of the PCB, corresponding to the relatively smaller elements 602A. Note that the elements can vary in size and configuration section to section, row to row, column to column, and element to element. In addition, it should be appreciated that the anechoic elements can have uniform shapes, e.g. pyramids, cones, etc., or can have irregular or randomly defined surfaces.

Note that while EMI in an optical transceiver is primarily produced from components positioned on the PCB, EMI can also be generated from the TOSA 22, the ROSA 24, or OSA-to-PCB interconnects such as flex circuits. Also, EMI can be generated within the host device and transmitted through the transceiver. This EMI requires dissipation as well and can be disrupted by the anechoic structure described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A communications module, comprising:

a shell including a bottom shell portion and a top shell portion, the bottom shell defining a cavity for one or more components including a printed circuit board;

a transmitter subassembly or a receiver subassembly disposed within the shell and configured to transmit or receive communications data;

the printed circuit board positioned within the cavity of the bottom shell portion, the printed circuit board including at least one component that produces electromagnetic interference; and one or more anechoic structures positioned on an inner surface of the shell and configured to disrupt and disperse electromagnetic interference present within the shell.

2. The communications module of claim 1, wherein the anechoic structure is positioned on an inner surface of the top shell portion and includes a plurality of anechoic elements arranged so as to extend towards the printed circuit board.

3. The communications module of claim 2, wherein during operation, electromagnetic interference impinging upon the plurality of anechoic elements is scattered, absorbed, or both, by the plurality of anechoic elements.

4. The communications module of claim 2, wherein the plurality of anechoic elements are arranged in a regular periodic pattern on the inner surface of the top shell portion.

5. The communications module of claim 2, wherein each of the plurality of anechoic elements includes one or more of cast zinc metal, radiation absorbent material, and Nickel.

6. The communications module of claim 5, wherein the radiation absorbent material includes a mixture of iron and carbon.

7. The communications module of claim 2, further comprising one or more anechoic elements arranged above, below, in back of, in front of, or to the side of the printed circuit board on one or more inner surfaces of the bottom shell portion.

8. A communications module, comprising:

a shell including a top shell portion;

a transmitter subassembly or a receiver subassembly disposed within the shell and configured to send or receive communications data;

a printed circuit board disposed within the shell, the printed circuit board including one or more components that produce electromagnetic interference; and an anechoic structure positioned on an inner surface of the top shell portion, the anechoic structure including:

a plurality of anechoic elements extending towards the printed circuit board and configured to intercept and disperse electromagnetic interference produced by the one or more components.

9. The communications module of claim 8, wherein the plurality of anechoic elements are of uniform length, the uniform length coinciding with an interfering wavelength of electromagnetic interference produced within the communications module.

10. The communications module of claim 9, wherein the uniform length is approximately equal to the interfering wavelength divided by twenty.

11. The communications module of claim 8, wherein the plurality of anechoic elements are positioned proximate to the one or more components that produce electromagnetic interference to intercept and disperse the electromagnetic interference produced by the one or more components before it can escape the shell.

12. The communications module of claim 8, wherein each of the plurality of anechoic elements forms a truncated pyramid, a column having a rounded top, or a cone.

13. The communications module of claim 8, wherein a first portion of the plurality of anechoic elements have a first height and a second portion of the plurality of anechoic elements have a second height which is less than the first height.

14. The communications module of claim 13, wherein the plurality of anechoic elements having the first height are interposed among the plurality of anechoic elements having the second height.

15. The communications module of claim 13, wherein:

relatively more electromagnetic interference is emitted from one or more components disposed on a first section of the printed circuit board than from one or more components disposed on a second section of the printed circuit board;

the plurality of anechoic elements having the first height are positioned proximate the one or more components disposed on the first section to intercept and disperse at least a portion of the relatively more electromagnetic interference; and the plurality of anechoic elements having the second height are positioned proximate the one or more components disposed on the second section to intercept and disperse electromagnetic interference from the one or more components disposed on the second section of the printed circuit board.

16. An optical transceiver module, comprising:

a shell including a bottom shell portion and a top shell portion;

a transmitter optical subassembly and a receiver optical subassembly disposed within the shell and configured to receive and transmit optical communications data;

a printed circuit board disposed within the shell, the printed circuit board including at least one component that produces electromagnetic interference; and an anechoic structure positioned on an inner surface of the top shell portion, the anechoic structure including:

a plurality of pyramidally-shaped elements arranged so as to extend toward the printed circuit board, the elements configured to intercept electromagnetic interference present within the transceiver shell.

17. The optical transceiver module of claim 16, wherein the top shell portion is configured to move between an open position and a closed position and wherein the top shell includes two sidewalls and the anechoic structure is positioned between the two side walls to avoid interfering with closure of the top shell portion relative to the bottom shell portion.

18. The optical transceiver module of claim 16, wherein the plurality of pyramidally-shaped elements are uniform in length, the length being greater than or equal to a interfering wavelength of electromagnetic interference generated within the optical transceiver module divided by twenty.

19. The optical transceiver module of claim 16, wherein the optical transceiver module is compliant with one or more of the following form factors: XFP, SFP, SFP+, IPF, and SFF.

20. The optical transceiver module of claim 16, wherein the position of the anechoic structure on the inner surface of the top shell portion coincides with the position of the printed circuit board and the at least one component that produces electromagnetic interference.

* * * * *